US005690314A

United States Patent [19]

Williams

[11] Patent Number: 5,690,314

[45] Date of Patent: Nov. 25, 1997

[54] WORK PLATFORM

[76] Inventor: Wilson Williams, 1117 W. Carpenter, Jerseyville, Ill. 62052

[21] Appl. No.: 603,369

[22] Filed: Feb. 20, 1996

[51] Int. Cl.[6] ..... E02C 3/00

[52] U.S. Cl. ..... 254/88; 254/93 L

[58] Field of Search ..... 254/88, 89 R, 254/90, 91, 89 H, 93 L

[56] References Cited

U.S. PATENT DOCUMENTS

| | | | |
|---|---|---|---|
| 1,978,622 | 10/1934 | Clapp | 254/93 L |
| 3,026,970 | 3/1962 | Woolslayer et al. | 254/88 |
| 3,088,547 | 5/1963 | MacMillan | 254/88 |
| 3,216,530 | 11/1965 | Hunter | 254/88 |
| 3,432,006 | 3/1969 | Senger | 254/91 |
| 4,088,303 | 5/1978 | Aquila | 254/88 |
| 4,724,930 | 2/1988 | VanLierop | 254/93 L |

*Primary Examiner*—James G. Smith
*Assistant Examiner*—Thomas W. Lynch
*Attorney, Agent, or Firm*—James E. Brunton

[57] ABSTRACT

A work platform assembly for supporting small vehicles such as garden tractors, riding mowers and the like at a height convenient for a mechanic to perform work on the device. The work platform assembly includes a vehicle support platform that can be lowered to a position wherein it is generally coplanar with an angularly inclined ramp so as to facilitate rolling the vehicle onto the vehicle support platform. First and second hydraulic lifting assemblies are provided for moving the support platform from the angularly inclined loading position to a generally horizontal position and for moving the inclined ramp of the assembly from an inclined position to a substantially vertical position wherein it supports the vehicle support platform when the latter is disposed in the generally horizontal position.

13 Claims, 4 Drawing Sheets

WORK PLATFORM

BACKGROUND OF THE INVENTION

FIELD OF THE INVENTION

The present invention relates generally to elevated work tables or platforms. More particularly, the invention concerns a novel work platform for supporting small vehicles such as garden tractors, riding mowers and the like at a height convenient for a mechanic to perform work on the device.

DISCUSSION OF THE INVENTION

In recent years small riding tractors such as garden tractors, mowers and the like have become popular for the performance of a variety of tasks around the house and garden. In addition to mowers, the tractors can be provided with various accessories such as plows, tillers and the like for plowing, tilling, and working the soil. The tractors may also be used for pulling small utility trailers and, when fitted with a power take-off, can be used to operate a wide variety of different kinds of appliances.

Typically, small vehicles are very low to the ground making the performance of maintenance and repair operations difficult. Accordingly, the thrust of the present invention is to provide a compact, stable and easy-to-use work platform that can be used to elevate small tractors and like vehicles to a height convenient for the mechanic to easily access the vehicle for the performance of the necessary repair and maintenance operations.

In the past various devices such as jacks, hoists, cranes and the like have been used to raise small vehicles to an elevated position so that access can be had to the engine, transmission and running gear of the vehicle. Additionally, U.S. Pat. No. 1,445,394 issued to Harvey discloses an auto table which is used to elevate a small automobile several feet above the ground to facilitate repair and maintenance of the automobile. The Harvey device basically comprises a pair of channel bars connected at their ends by crossbars with an upright bar at each end of the ends of the upright bars. Connected at one end of the elevated table is an inclined ramp which can be used to run the automobile up onto the table.

As will be better appreciated from the discussion which follows, the work platform of the present invention offers numerous advantages over the prior art devices and for the first time provides a practical work platform for use in performing maintenance and repair on a variety of small vehicles such as garden tractors, riding mowers and the like.

SUMMARY OF THE INVENTION

It is an object of the present invention to provide an elevated work platform assembly for supporting a small vehicle, such as a garden tractor, at a height convenient for a workman to perform maintenance and repair on the vehicle.

It is another object of the invention to provide a work platform assembly of the aforementioned character which includes an inclined ramp for use in rolling the vehicle on to elevated vehicle support platform of the assembly.

Another object of the invention is to provide a work platform assembly as described in the preceding paragraphs in which one end of the vehicle support platform can be lowered to a position wherein the support platform is generally coplanar with the inclined ramp so as to facilitate rolling the vehicle onto the vehicle support platform.

Another object of the invention is to provide a work platform assembly of the character described in the preceding paragraph which include winch means for use in pulling the vehicle up the ramp assembly and onto the vehicle support platform.

Another object of the invention is to provide a work platform assembly which includes hydraulic lifting means for lifting the vehicle support platform from its lowered position to an upraised position wherein the vehicle support platform is substantially horizontal.

Still another object of the invention is to provide a work platform assembly as described in the previous paragraphs which further includes an extension platform, one end of which can be connected to the vehicle support platform and the other end of which can rest on the bed of a truck so that the vehicle can be rolled from the vehicle support platform over the extension platform and into the bed of the truck.

Another object of the invention is to provide a work platform assembly of the character described which further includes a second hydraulic lifting means for moving the inclined ramp of the assembly from an inclined position to a substantially vertical position wherein it supports the vehicle support platform when the latter is disposed in the generally horizontal position.

Another object of the invention is to provide a work platform assembly of the class described which is of simple construction and is compact, easy to use, highly stable and efficient in operation.

DISCUSSION OF THE INVENTION

Figure 1:
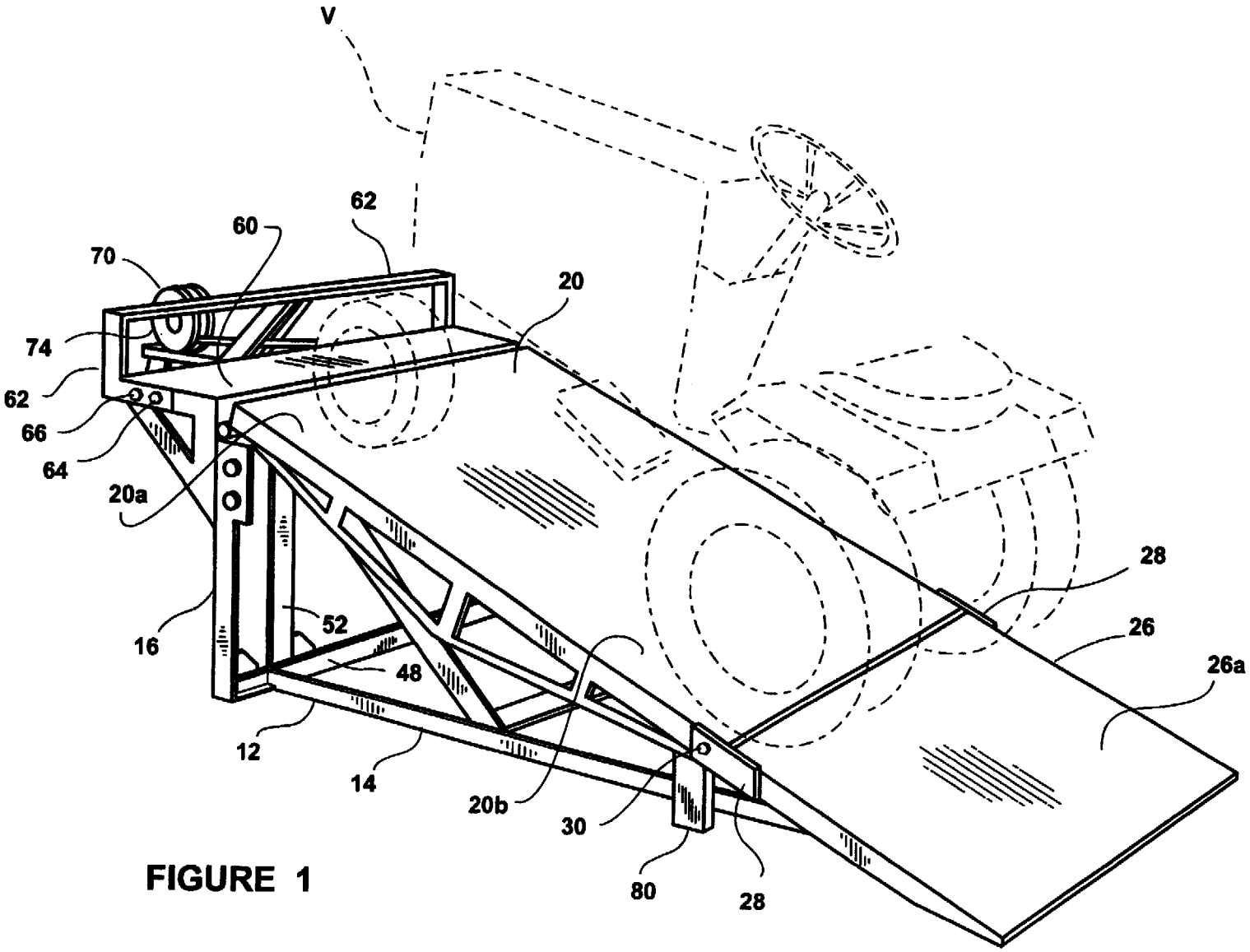
FIG. 1 is a generally perspective view of one form of the work platform of the present invention shown in a vehicle loading configuration.

Referring to the drawings and particularly to FIGS. 1 through 4, one form of the work platform of the invention is there shown and generally designated by the numeral 12. The work platform of this embodiment of the invention for supporting a small vehicle "V" comprises a ground-engaging base 14, a pair of transversely spaced-apart, upwardly extending support members 16 and 18 which are connected to base 14 and a generally planar work platform 20.

Figure 2:
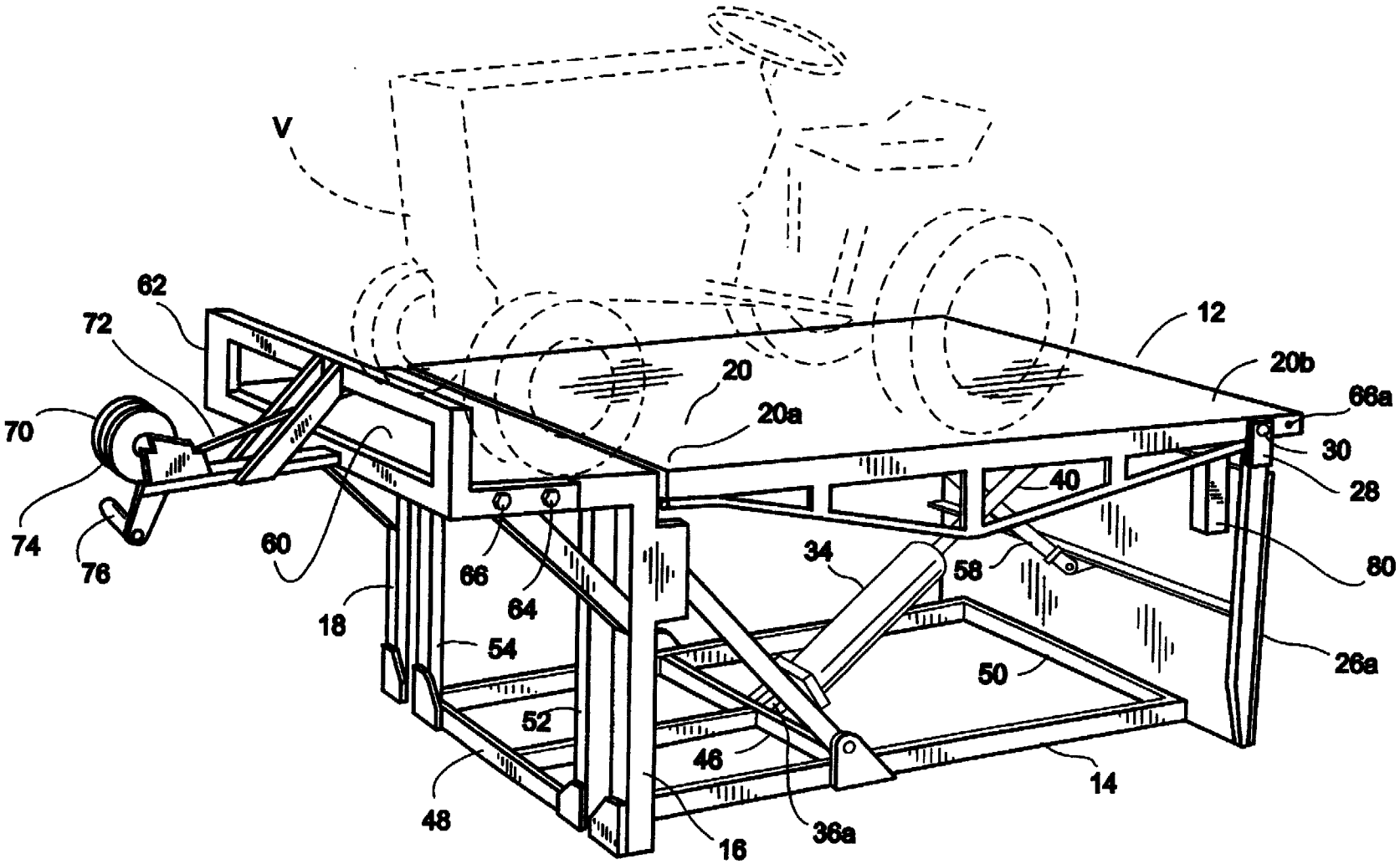
FIG. 2 is a generally perspective view of the work platform of FIG. 1 but shown in an upstanding, operating position.
Figure 3:
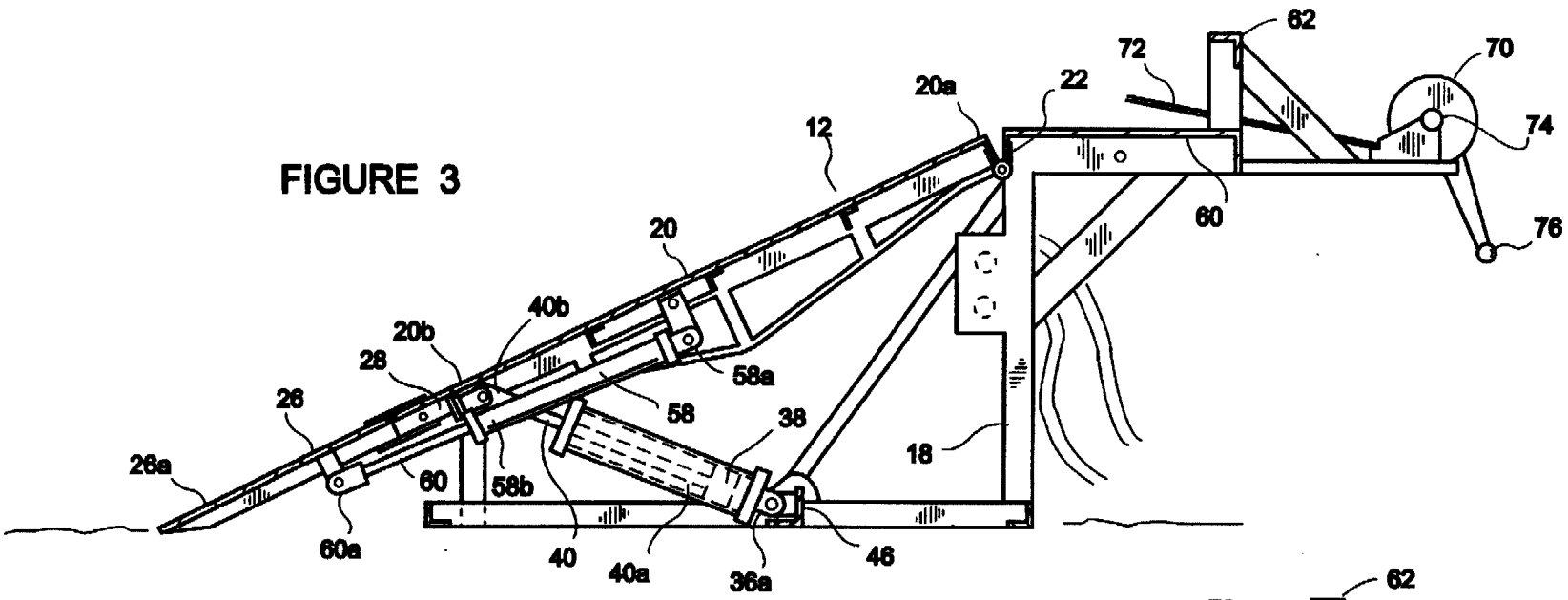
FIG. 3 is a side-elevational view, partly in cross section, showing internal construction of the work platform in the loading configuration shown in FIG. 1.
Figure 4:
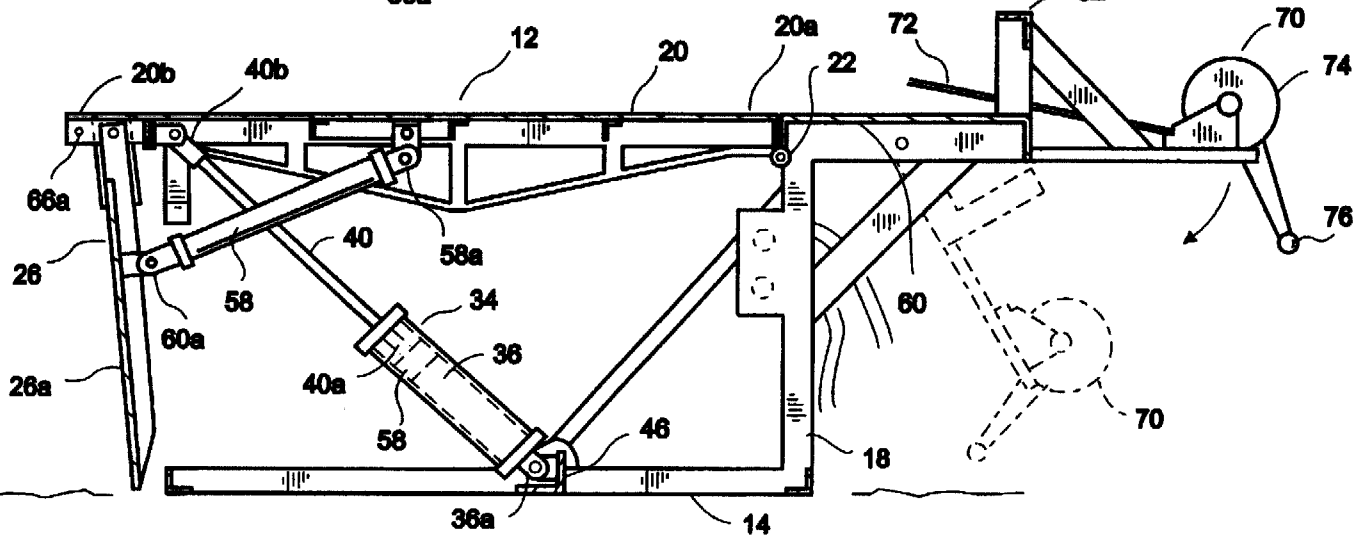
FIG. 4 is a side-elevational view, partly in cross section, to show internal construction of the apparatus in its elevated operational configuration as shown in FIG. 2.

As best seen in FIGS. 3 and 4, work platform 20 has first and second end portions 20*a* and 20*b* and is hingeably connected proximate its first end 20*a* to upwardly extending support members 16 and 18. As is also indicated in FIGS. 1 and 2, hinge assembly 22 permits pivotal movement of support platform 12 between the first, angularly downwardly extending position shown in FIGS. 1 and 3 to the second upwardly extending, generally horizontal position shown in FIGS. 2 and 4.

Also comprising a part of the work platform assembly of the embodiment of the invention shown in the drawings is a ramp assembly 26 which includes a planar ramp portion 26a and a pair of connector arms 28 which are connected to ramp 26a and extend outwardly therefrom in the manner best seen in FIGS. 1 and 2. Connector arms 28 are pivotally connected to the sides of planar platform 20 proximate end portion 20b thereof by means of conventional connectors such as bolts 30. With this construction, ramp assembly 26 is movable between the first position shown in FIG. 1, wherein ramp 26a is generally coplanar with work platform 20, to a second position shown in FIG. 2, wherein ramp 26 extends downwardly in a generally vertical relationship. In this downward position, the ramp assembly uniquely functions to support work platform 20 when the work platform is in the upraised, generally horizontal position shown in FIG. 2. As indicated in FIG. 2, connectors 30, which define the pivot axes about which ramp 26 pivots, are located inboard of the rearward end of work platform 20 so that when ramp 26a is in its second generally vertical position end portion 20b of the work platform extends rearwardly of the plane of ramp 26a. With this construction, the workman can stand immediately adjacent the end of the work platform assembly without ramp 26a interfering with the comfortable placement of the workman's feet.

To move the work platform assembly from the first downwardly inclined position shown in FIG. 1 to the second, generally horizontal position shown in FIG. 4, lifting means are provided. These lifting means here comprise a hydraulic lifting assembly generally designated by the numeral 34. Assembly 34 is of a conventional construction and comprises a hydraulic cylinder 36 within which a piston 38 is reciprocally movable by force exerted by a hydraulic. As best seen in FIG. 3, the first end 40a of a connecting rod is connected to piston 38 while the second end 40b thereof is connected to the undersurface of platform assembly 20 proximate end portion 20b thereof. As indicated in FIG. 2, hydraulic cylinder 36 is interconnected proximate its closed or lower end 36a with a transversely extending ground-engaging member 46 which comprises a part of the ground-engaging base assembly 14. With this construction, as fluid under pressure is introduced into cylinder 36, piston 38 will be urged to move from the position shown in FIG. 3 to the position shown in FIG. 4. This movement of piston 38 within cylinder 36 causes connecting rod 40 to lift platform assembly 20 from its first inclined position shown in FIG. 3 into its upraised position shown in FIG. 4. The construction, operation and installation of the conventional hydraulic lifting assembly 34 is well understood by those skilled in the art and need not be described in detail herein.

As can be seen by referring to FIG. 2, the ground-engaging base assembly 14 further includes a pair of spaced-apart, transversely extending, ground-engaging end members 48 and 50 which provide rigidity to the base assembly. To provide further support to the work platform, a second pair of generally vertical extending support members 52 and 54 are connected to and extend upwardly from the base assembly in the manner shown in FIG. 2.

Turning to FIG. 4, it can be seen that a second lifting means is provided for moving ramp assembly 26a between the first lowered position shown in FIGS. 1 and 3 to the second generally vertically extending position shown in FIGS. 2 and 4. This second lifting means is also of conventional construction and comprises a second hydraulic cylinder 58 within which a piston reciprocates in a conventional manner to move the end 60a of a connecting rod 60 (FIG. 3) from the extended position shown in FIG. 3 to the retracted position shown in FIG. 4. As indicated in FIGS. 3 and 4, end 58a of hydraulic cylinder 58 is connected to platform assembly 20 intermediate end portion 20a and 20b, while end 60a of connecting rod 20 is interconnected with ramp assembly 26. With this construction, as hydraulic fluid enters hydraulic cylinder 58 proximate end 58b thereof (FIG. 3), connecting rod 60 will be caused to move inwardly of the hydraulic cylinder which in turn results in the movement of the ramp assembly 26 from the inclined position shown in FIG. 3 to the generally upright position shown in FIG. 4. Once again, the construction, interconnection and operation of the second hydraulic lifting means of the invention is well understood by those skilled in the art. It is to be understood that, while hydraulic lifting means are shown in the drawings, pneumatic lifting means can also be used.

Forming an important aspect of the apparatus of the present invention is the provision of stop means for engaging the vehicle "V" to stop its forward movement as it is rolled upwardly of the incline made up of work platform 20b and ramp 26a (FIG. 1). As the vehicle "V" reaches the position shown in FIG. 2, the front wheels of the vehicle will engage the stop means and prevent further forward movement of the vehicle. In the form of the invention shown in the drawings, the stop means comprises a generally planar member 60 which is connected to and supported in a generally horizontal position by upwardly extending support members 16, 18, 52, and 54. The stop means also includes a stop frame 62 which is pivotally connected to member 60 by means of a pair of oppositely disposed connectors 64. A second pair of connectors 66 are removably interconnected with planar member 60 and, when connected to member 60, retain frame 62 in the operable, vehicle supporting position shown in FIGS. 1, 2, and 3. For reasons presently to be described, when connectors 66 are disconnected from member 60, frame assembly 62 can be pivotally movable about connectors 64 from the first operable position shown by the solid lines in FIG. 4 to the second lowered position as generally indicated by the dotted lines in FIG. 4.

Another important feature of the apparatus of the present invention comprises winch means for use in winching the vehicle to be repaired up the inclined ramp defined by platform 20 and ramp 26a (FIG. 1). This winch means here comprises a conventional hand-operated winch assembly 70, which is interconnected with frame assembly 62 and is movable therewith when the frame assembly is moved from the first upright position shown by the solid lines in FIGS. 4 to the lowered position indicated by the dotted lines in FIG. 4. Winch assembly 70 is of conventional construction and includes an elongated cable 72, one end of which is connected to the drum 74 of the winch assembly and the other end of which can be interconnected with the vehicle by any suitable means such as a hook or like connector.

In using the apparatus of the invention, the hydraulic means are initially operated to place the apparatus into the configuration shown in FIG. 1. With the cable 72 appropriately connected to the vehicle, rotation of the crank 76 of the winch means will permit the vehicle to be winched or rolled up the inclined plane from the position shown in FIG. 1 to the full forward position shown in FIG. 2 wherein the wheels of the vehicle are in engagement with frame assembly 62. As best seen in FIG. 1, when the apparatus is in the lowered configuration, a pair of transversely spaced legs 80, which are connected to platform assembly 20, provide vertical support to the rearward, or second end portion 20b of the platform assembly. After the vehicle has been moved into the configuration shown in FIG. 2, hydraulic assembly 34 is operated to raise end 20b of the platform assembly from the inclined position shown in FIG. 1 to the generally horizontal position shown in FIG. 2. Simultaneously, the second hydraulic lifting means or hydraulic cylinder 58 is operated to cause an inward force to be exerted on ramp assembly 26 causing ramp 26a to move from the first inclined position shown in FIG. 1 to the second, generally vertically extending work platform support position shown in FIG. 2. With the apparatus in this operating position, the workman can conveniently gain access to the various parts of the vehicle in order to perform necessary maintenance and repair operations in a safe, comfortable and efficient manner. When work on the vehicle is completed, the aforementioned sequences of steps can be reversed and, through operation of the lifting means of the invention, the device can be returned to the position shown in FIG. 1 wherein the vehicle can be rolled down in the inclined plane and onto the ground.

Figure 5:
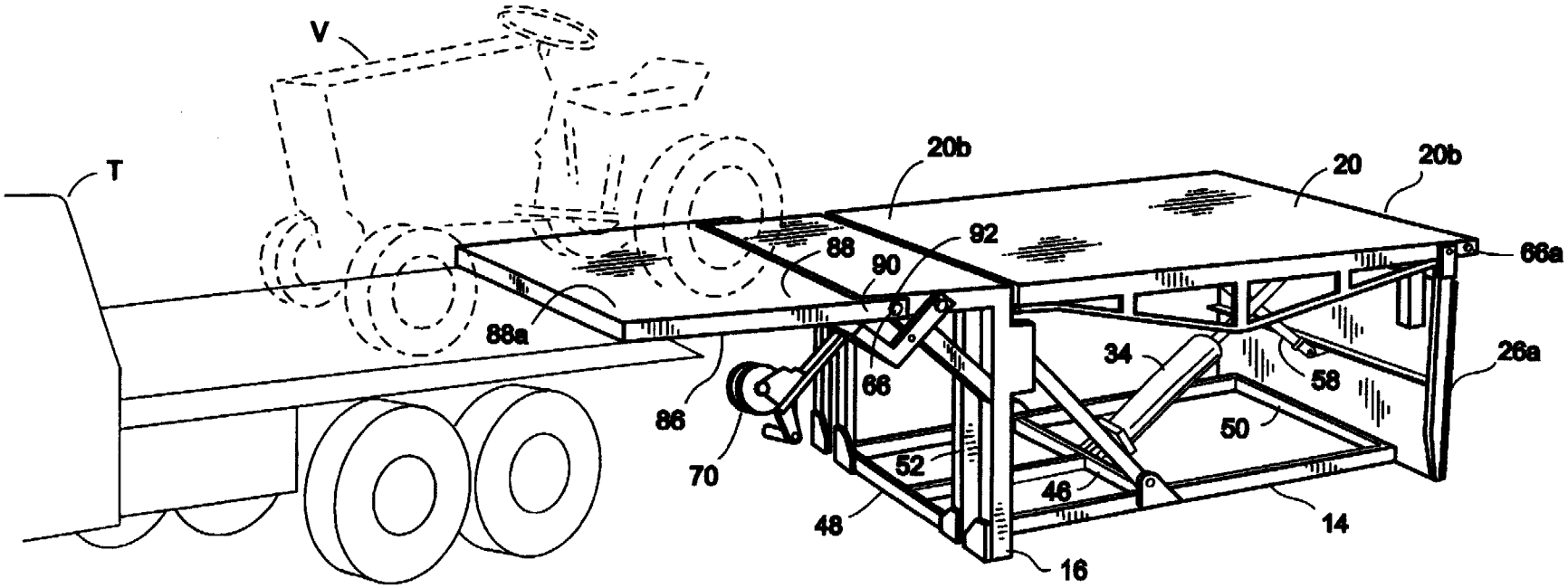
FIG. 5 is a generally perspective view similar to FIG. 4, but showing the extension platform of the assembly of the invention interconnected with the work platform assembly to enable transfer of the vehicle from the work platform to the bed of the truck.

Turning to FIG. 5, an alternate disposition of the repaired vehicle can be accomplished through use of the novel extension platform assembly of the present invention. This unique assembly, which is generally designated in FIG. 5 by the numeral 86, comprises a generally planar member 88 from which a pair of extension arms 90 extend. After the safety or stop frame 62 and winch assembly 70 been moved into its lowered position by the removal of connectors 66, which are disposed on either side of member 60, arms 90 can be interconnected with planar member 60 by reinserting connectors 66 through suitable apertures 92 formed in rearwardly extending arms 90. With the extension platform thus pivotally connected to member 60, the forward end 88a of the extension platform can be lifted so that a transport vehicle such as a truck "T" can be moved into the position shown in FIG. 5 wherein the forward end 88a of the extension platform will rest on the bed of the truck. With the apparatus in this configuration, the vehicle "V" can be rolled forwardly of extension platform 88 and onto the bed of the truck in the manner shown in FIG. 5 for transport to a desired location.

As shown in FIG. 5, a second set of connectors 66a are provided proximate the second end 20b of the work platform so that, when ramp assembly 26a is in the lowered, vertical position, arms 90 of extension platform assembly can also be pivotally connected to this end of the work platform. With this construction, the vehicle "V" can also be loaded on the bed of the truck positioned proximate end 20b of the work platform.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A work platform comprising:

(a) a base;

(b) a pair of spaced-apart support members connected to said base;

(c) a platform having first and second ends, said first end being pivotally connected to said pair of spaced-apart support members for movement of said second end thereof between a lowered position and an upraised position;

(d) a ramp pivotally connected to said platform proximate said second end thereof for movement between a first position wherein said ramp extends at an acute angle relative to said base to a second substantially vertically extending position;

(e) lifting means for moving said platform between said lowered position and said upraised position;

(f) a stop assembly connected to said support members, said stop assembly comprising:

(i) a generally planar member connected to said support members; and (ii) a stop frame pivotally connected to said generally planar member for movement between an upright position and a retracted position; and (g) an extension platform assembly adapted to be pivotally connected to said planar member of said stop assembly when said stop frame is in said retracted position.

2. A work platform for supporting a vehicle comprising:

(a) a ground engaging base;

(b) a pair of transversely spaced-apart, upwardly extending support members connected to said base;

(c) a generally planar platform having first and second longitudinally spaced end portions, said first end portion being pivotally connected to said support members for movement between a first angularly downwardly extending position to a second upraised, generally horizontal position;

(d) a ramp pivotally connected to said platform proximate said second end portion thereof for movement between a first position wherein said ramp is generally coplanar with said generally planar platform to a second position wherein said ramp extends generally perpendicularly to said base;

(e) lifting means for moving said generally planar platform from said first position to said second position; and (f) an extension platform connected to said planar platform and extending outwardly therefrom.

3. A work platform as defined in claim 2 further including second lifting means for moving said ramp from said first position to said second position.

4. A work platform as defined in claim 2 further including winch means for interconnection with the vehicle to move the vehicle along said ramp.

5. A work platform as defined in claim 2 further including stop means pivotally connected to said extension platform for engagement with the vehicle to restrain movement thereof.

6. A work platform for supporting a vehicle comprising:

(a) a ground engaging base;

(b) a pair of transversely spaced-apart, upwardly extending support members connected to said base;

(c) a generally planar platform having first and second longitudinally spaced end portions, said first end portion being pivotally connected to said support members for movement between a first angularly downwardly extending position to a second upraised, generally horizontal position;

(d) a ramp assembly comprising a generally planar ramp and a pair of connector arms connected to said generally planar ramp, said connector arms extending outwardly from said ramp and being pivotally connected to said generally planar platform, for movement of said ramp between first and second positions;

(e) first hydraulic lifting means for moving said generally planar platform from said first position to said second position, said first hydraulic lifting means comprising:
  (i) an hydraulic cylinder having first and second ends said first end of the cylinder being connected to said base;
  (ii) a piston reciprocally movable within said hydraulic cylinder; and
  (iii) a connecting rod having first and second ends said first end of the connecting rod being connected to said piston and said second end of the connecting rod being connected to said generally planar platform;

(f) second hydraulic lifting means for moving said generally planar ramp of said ramp assembly from said first position to said second position, said second hydraulic lifting means comprising:
  (i) an hydraulic cylinder having first and second ends said first end of the cylinder being connected to said base;
  (ii) a piston reciprocally movable within said hydraulic cylinder; and
  (iii) a connecting rod having first and second ends said first end of the connecting rod being connected to said piston and said second end of the connecting rod being connected to said generally planar platform;

(g) winch means for interconnection with the vehicle to move the vehicle along said ramp assembly;

(h) a stop assembly connected to said support members, said stop assembly comprising:
  (i) an extension platform assembly adapted to be pivotally connected to said generally planar member of said stop assembly when said stop frame is in said lowered position.

7. A work platform as defined in claim 6 in which said extension platform assembly comprises a generally planar extension platform and a pair of outwardly extending arms adapted to be removably connected to said generally planar member when said stop frame is in said lowered position.

8. A work platform as defined in claim 6 in which said base comprises:

(a) a pair of spaced-apart longitudinally extending ground engaging channels each having end portions; and (b) a pair of spaced-apart transversely extending ground engaging channels connected to said longitudinally extending ground engaging channels proximate said end portions thereof.

9. A work platform as defined in claim 8 in which said base further includes a transversely extending intermediate channel connected to said pair of longitudinally extending ground engaging channels intermediate said end portions thereof.

10. A work platform as defined in claim 9 in which said first hydraulic lifting means is connected to said intermediate channel.

11. A work platform comprising:

(a) a base;

(b) a pair of spaced-apart support members connected to said base;

(c) a platform having first and second ends, said first end being pivotally connected to said pair of spaced-apart support members for movement of said second end thereof between a lowered position and an upraised position;

(d) a ramp pivotally connected to said platform proximate said second end thereof for movement between a first position wherein said ramp extends at an acute angle relative to said base to a second substantially vertically extending position;

(e) lifting means for moving said platform between said lowered position and said upraised position;

(f) a stop assembly connected to said support members; and (g) an extension platform connected to said platform and extending outwardly therefrom.

12. A work platform as defined in claim 11 further including lifting means for moving said ramp between said first and second positions.

13. A work platform as defined in claim 12 further including winch means for interconnection with a vehicle to move the vehicle along said ramp.

* * * * *